United States Patent [19]

Haugen

[11] 4,087,197

[45] May 2, 1978

[54] GAS COMPRESSOR, AND FOR USE WITH A GAS COMPRESSOR: GEAR HOUSING AND GAS-HANDLING ASSEMBLY, AND HEAT EXCHANGING ASSEMBLY

[75] Inventor: Ronald L. Haugen, Mayfield, Ky.

[73] Assignee: Ingersoll-Rand Company, Woodcliff Lake, N.J.

[21] Appl. No.: 720,587

[22] Filed: Sep. 7, 1976

Related U.S. Application Data

[62] Division of Ser. No. 581,218, May 27, 1975, Pat. No. 4,010,016.

[51] Int. Cl.[2] ..... F04D 13/14; F04D 25/16; F04D 29/58

[52] U.S. Cl. ..... 415/66; 415/168; 415/179; 415/DIG. 7; 417/243

[58] Field of Search ..... 415/121 A, 168, 179, 415/DIG. 7, 122 R, 198.1, 66, 60; 417/243, 244

[56] References Cited

U.S. PATENT DOCUMENTS

| | | | |
|---|---|---|---|
| 1,511,517 | 10/1924 | Henderson | 415/122 R UX |
| 3,001,692 | 9/1961 | Schierl | 415/122 R UX |
| 3,355,097 | 11/1967 | Hornschuch | 415/121 G UX |
| 3,658,442 | 4/1972 | Heitmann et al. | 417/243 |

*Primary Examiner*—Carlton R. Croyle

*Assistant Examiner*—Donald S. Holland

*Attorney, Agent, or Firm*—Bernard J. Murphy

[57] ABSTRACT

The compressor, as evidenced in the several embodiments presented herein, comprises, in its essentials, a self-contained gear housing which, centrally thereof, receives a power input shaft for driving a bull gear. The bull gear drives either one or a plurality of other gears which, in turn, are coupled to one or a complementary plurality of gas compressing impellers. Integral with the outer wall of one side of the gear housing is defined one or a same plurality of gas handling structures within which the impeller(s) are confined. The gas handling structures comprise inlet pipes, compression chambers, diffusers and open-ended plenum chambers. According to the requirements of the user, domed enclosures are replaceably bolted to the gas handling structure either directly, or through intervening inter- or after-cooler heat exchangers, and with inter-stage ducting, to define of the gas compressor either a single compressing stage, a plurality of independent stages, or successive, series-coupled compressing stages. The several components comprising the gear housing, gas handling structure, domed enclosure, and heat exchanger are compact, self-contained, cooperatively engageable, and replaceable, to provide the user with optional design configurations for particular applications.

10 Claims, 7 Drawing Figures

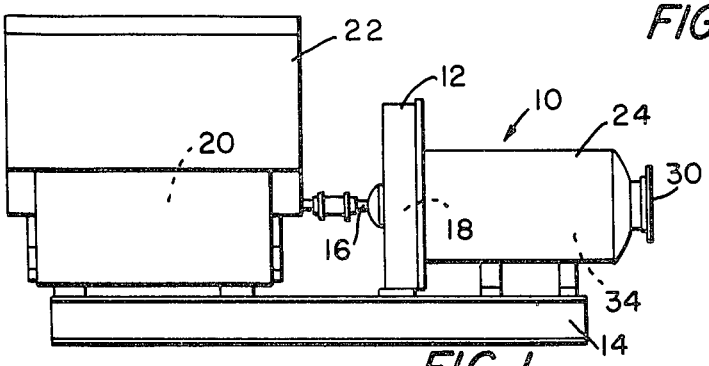
FIG. 1
FIG. 2
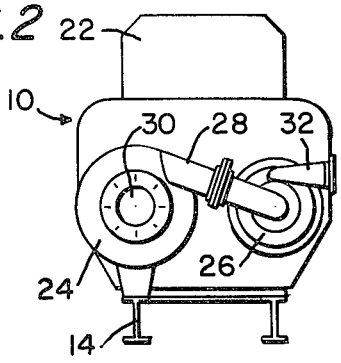
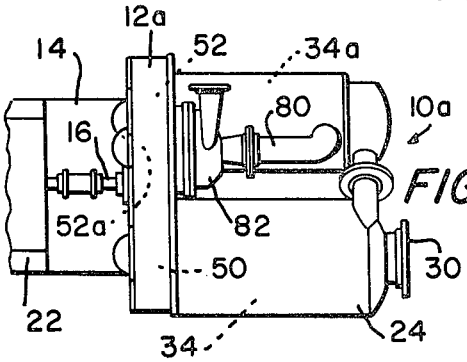
FIG. 4
FIG. 5
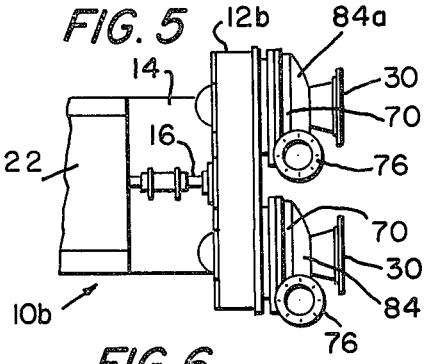
FIG. 6
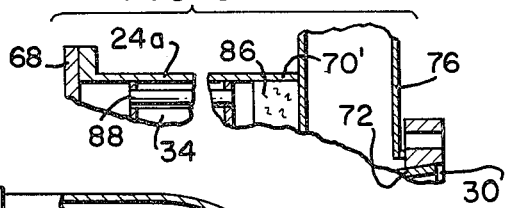
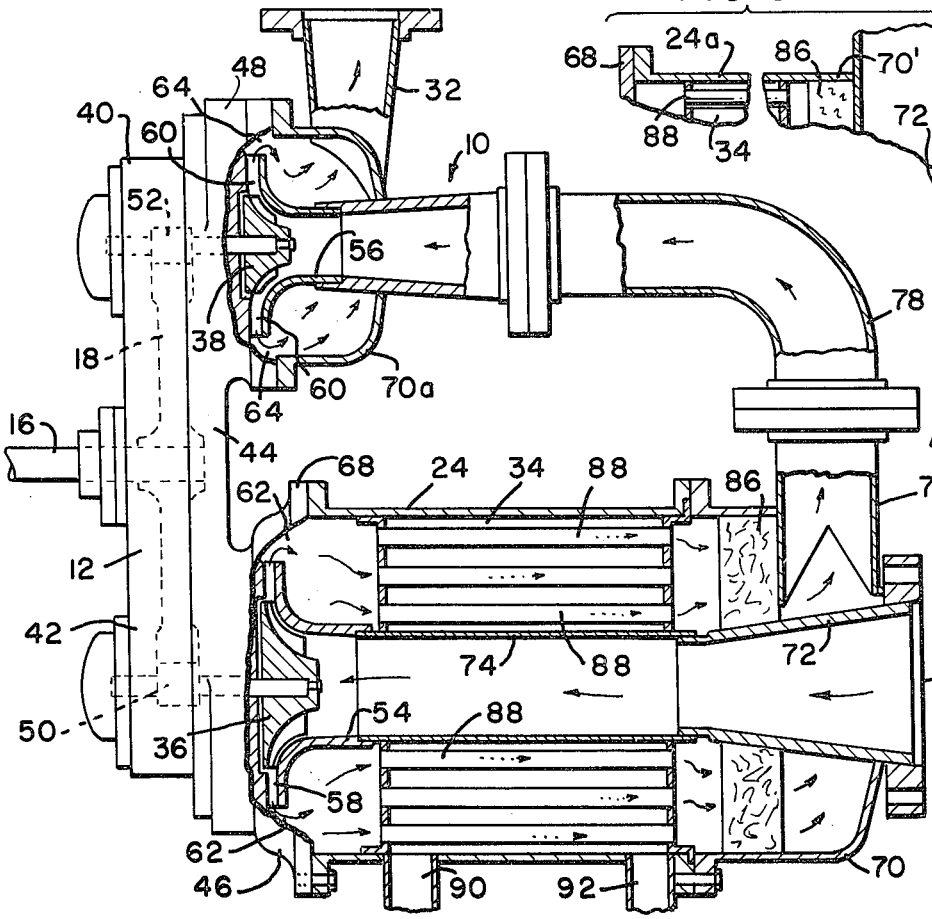
FIG. 3

GAS COMPRESSOR, AND FOR USE WITH A GAS COMPRESSOR: GEAR HOUSING AND GAS-HANDLING ASSEMBLY, AND HEAT EXCHANGING ASSEMBLY

This is a division of application Ser. No. 581,218 filed May 27, 1975, now U.S. Pat. No. 4,010,016.

This invention pertains to gas compressors, and in particular to gas compressor packaging arrangements which, building from efficient, self-contained components, offer a wide flexability of design, respecting output, application, and the like, and which provide for economies in manufacture and maintenance.

In prior gas compressors, the packaging arrangements thereof have been defined by the requirements of the machinery. This necessitates that each arrangement or design must be substantially discrete, requiring considerable manufacturing and maintenance-spares expense. Such prior gas compressors offer little flexability in design, and few efficient, self-contained, integrated components. An exception to this can be found in U.S. Pat. No. 3,355,097 issued to Hanns Hornschuch on Nov. 28, 1967 for a "Fluid Machine." In the aforenoted patent, the Patentee defined fluid machines, such as a gas compressor, which offered an attractive, economical, and readily "maintainable" structure. The patent disclosed, in particular, a gas compressor packaging arrangement in which substantially all inter-stage ducting is self-contained within an end panel or closure which is hinged to the housing. According to the present invention, inter-stage ducting—if employed—is external, however, a wide flexability of design is offered in the packaging of the compressor, according to the invention, with compact, self-contained, mutually couplable, and easily replaceable components.

It is an object of this invention, therefore, to set forth a gas compressor defined of such packagable components, comprising a gear housing; a driving gear and at least one driven gear enclosed within said housing; said gears being in mutual engagement for rotation in parallel axis; said housing having parallel walls; a power input shaft, in penetration of one of said walls, drivingly coupled to said driving gear; an impeller for compressing gas coupled to said one driven gear, externally of said housing, for common rotation with said driven gear; first means for admitting gas to said impeller; and second means for discharging gas from said impeller; wherein said first and second means comprise an integral structure replaceably coupled to said housing in envelopment of, and concentric with, said impeller; one of said first and second means defines an annular chamber; said chamber has a closure head; and the other of said first and second means is in penetration of said closure head.

Further objects and features of this invention will become more apparent by reference to the following description taken in conjunction with the accompanying figures in which:

FIG. 1 is a side elevation, in outline, of a gas compressor according to the invention, the same being shown fixed to one end of a skid or platform and being coupled to a power plant mounted at the other end of the platform.

FIG. 2 is an end view of the arrangement of FIG. 1, taken from the right side of FIG. 1, and showing the inter-ducting and closures for the two stages comprised by this embodiment;

FIG. 3 is a cross-sectional view of the FIGS. 1, and 2 embodiment, taken generally through the plane in which both rotary axes of the two stages are found;

FIG. 4 is a plan view of an alternate embodiment of a gas compressor, according to the invention, in which a series of three compressing stages are provided;

FIG. 5 is yet another embodiment, also in plan view, of the invention, wherein a pair of independent compressing stages are defined;

FIG. 6 is a fragmentary cross-sectional view of a modified version of the FIGS. 1–3 embodiment of the inventon;

Figure 7:
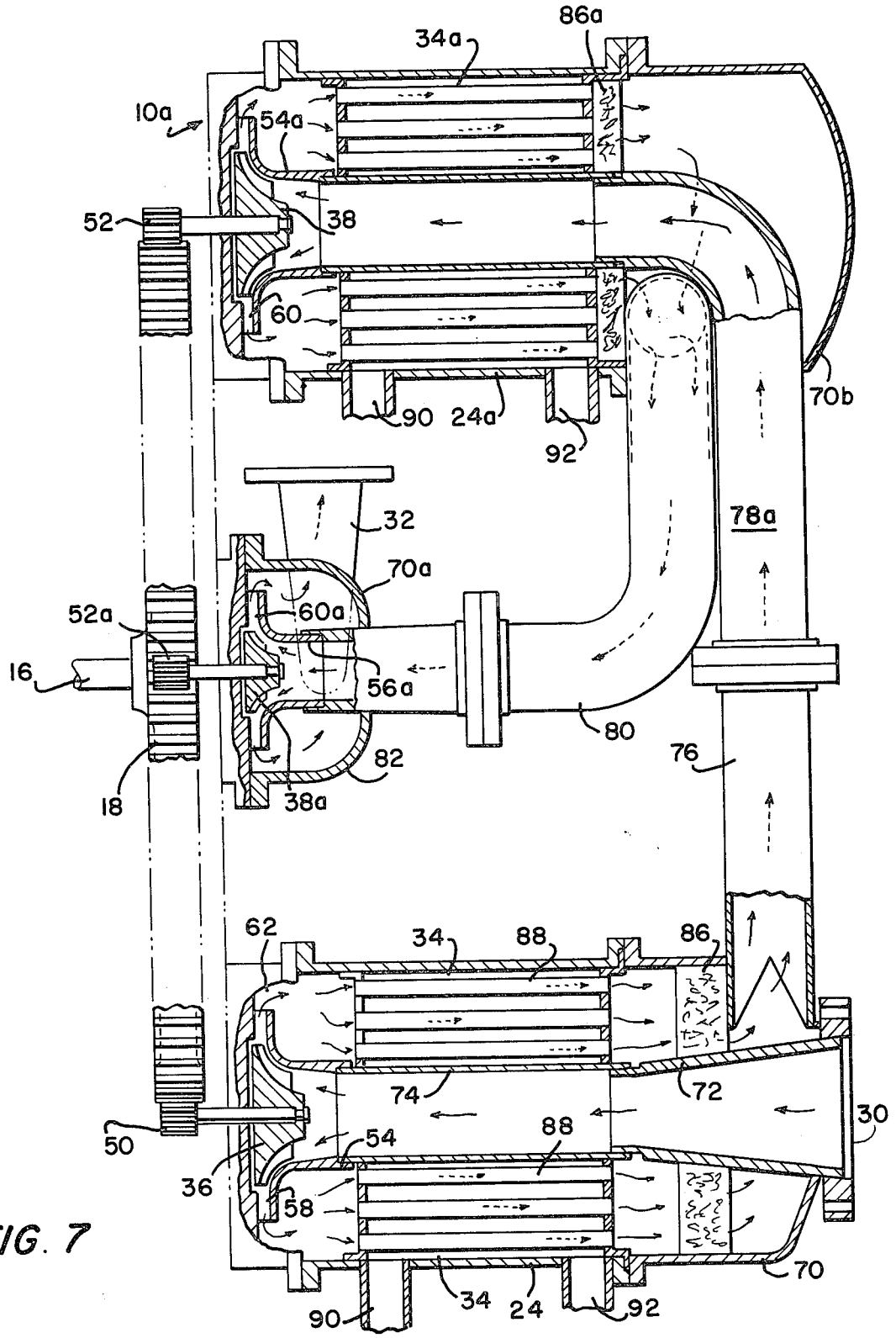
FIG. 7 is a contrived or folded-out depiction of the alternative embodiment of FIG. 4, shown in enlarged scale and in cross-section, with the gear housing omitted for purposes of clarity.

As shown in FIGS. 1 and 2, the gas compressor 10 comprises a gear housing 12, fixed to a platform 14, which has a drive shaft 16 coupled thereto, centrally thereof, via a bull gear 18 for driving gears which power impellers. The drive shaft 16 is coupled to a power plant 20 enclosed within a housing 22. In the end view, FIG. 2, it can be seen that two stages of compression are arranged side by side, each thereof being enclosed within housing shells 24 and 26. Ducting 28 conducts the outlet of the first stage to the inlet of the second stage. A flanged opening 30 comprises the inlet for the first stage, and a tangential cnduit 32 carries off the product of the second stage. As will be seen more clearly in FIG. 3, shell 24 is an external wall of an intercooler heat exchanger 34.

The embodiment of FIGS. 1 and 2 is shown in more detail, and in cross-section, in FIG. 3, the cross-section taken generally through the plane in which first and second stage impellers 36 and 38 rotate on parallel axes. The gear housing 12 is self-contained being defined by a perimeter wall 40 and parallel side walls 42 and 44. The drive shaft 16 is in penetration of side wall 42 and the impellers 36 and 38 are external of the housing being enclosed in gas handling structures 46 and 48 which are integral with wall 44. The bull gear 18 drivingly engages the first and second stage gears 50 and 52 which in turn power the respective impellers 36 and 38.

Structures 46 and 48 define, centrally thereof, inlet pipes 54 and 56 for admitting gas to each of the stages' impellers, and also comprise diffusers 58 and 60 and open-ended plenums 62 and 64. The first stage has an annular inter-cooler, i.e. the heat exchanger 34 bolted to the flange 68 of the structure 46 and a cup-shaped domed closure or closure head 70 is, in turn, bolted to the heat exchanger. Both the domed closure or closure head and the heat exchanger have central pipes 72 and 74 which are matingly engaged to define a common central inlet pipe for admitting gas to the impeller 36 of the first stage. The domed closure or closure head also has a tangential outlet pipe 76 for discharging the compressed gas product of the first stage. It will be self-evident that, if desirable, the heat exchanger can be dispensed with, and the domed closure or closure head 70 can be bolted directly to the flange 68 of the structure 46. Pipes 72 and 74 axially traverse or penetrate the closure head 70 and the heat exchanger 34; the latter, then, is of annular configuration, and pipe 72 defines, thereabout, an annular chamber within closure head 70.

The tangential outlet pipe 76, comprising part of ducting 28, is, in turn, bolted to a 90° elbow 78 which, in turn, is bolted to a second domed closure or closure head **70*a*, the latter being replaceably fixed about the second stage impleller 38. Each end of elbow 78 has a coupling flange formed thereon. One of the flanges, of course, is removably bolted to a terminal flange formed on the end of outlet pipe 76, and the other thereof is removably bolted to the flanged opening (corresponding to opening 30 of closure head 70) projecting from the second domed closure or closure head 70***a*. Closure head 70*a* has an annular flange formed about the open end thereof which is bolted to an external flange (corresponding to flange 68) which extends from structure 48, and has the tangential outlet pipe 32 for withdrawing the compressed gas product. If it will be deemed advisable or desirable, the elbow 78 could be dispensed with and an after-cooler could be bolted in place in the second stage (in the same manner as the inter-cooler 34 is provided for the first stage). Inter-cooler 34, of course, has terminal flanges which, at either ends, are removably bolted to the annular flange formed on the open end of closure head 70, and to the flange 68 which extends from the structure 46. Such an after-cooler heat exchanger would be bolted to the second stage structure 48; the gas input for such an embodiment would be supplied directly by pipe 76 into a modified, second stage end closure, and the second stage outlet would be arranged in a side wall of the after-cooler outer shell. Such an arrangement is outlined in FIG. 4.

As shown in FIG. 4 a further embodiment comprises a compact gear housing 12*a* again bolted to a skid or platform 14 but which, in this arrangement, accommodates for three stages of compression. The first stage is substantially identical to the first stage of the embodiment in FIGS. 1 through 3. However, the second stage does have a intercooler heat exchanger 34*a*, and from an end portion thereof is arranged a delivery pipe 80 which conducts the product to a third stage 82. In this arrangement, instead of two driven gears 50 and 52 (FIG. 3) arranged at opposite sides of the bull gear 18, there are three driven gears 50, 52 and 52*a* deployed about the periphery of the bull gear, within the gear housing 12*a*, each driving an impeller.

The embodiment shown in FIG. 5 shows a further packaging arrangement where the compressor 10*b* has single stages of compression provided on that which is basically a same gear housing 12*b;* two compression stages 84 and 84*a* are side by side and supply parallel outputs. As noted before, it is quite within the option of the user to add to one or both of these two stages a heat exchanger, according to the practice shown in FIG. 3 and, if desirable, to so modify the arrangement as to have stage 84 supply its output to stage 84*a* for further compression.

To revert to FIG. 3, domed closure or closure head 70 incorporates a demister 86, to collect water vapor which may be entrained in the gas product, and by conventional means (not shown) the collected liquid is drained from the compressor 10. The heat exchanger 34 has throughput pipes 88, arranged in straight columns and rows (to facilitate cleaning), for conducting the gas product therethrough. Ports 90 and 92 supply and discharge coolant to and from the heat exchanger, in a manner well known in the art.

The embodiment shown only in a discontinuous and fragmentary cross-section in FIG. 6 is a modified version of the novel gas compressor of FIGS. 1–3. In this latter embodiment the domed closure 70' and housing shell 24*a* are integral—the two being formed as a single article of manufacture. The shell 24*a* is bolted (hardware not shown) replaceably to flange 68 of structure 46. Domed closure or closure head 70' (like closure 70, FIG. 3) incorporates the same flanged opening 30, central pipe 72, and outlet pipe 76, and encloses demister 86. Too, shell 24*a* encloses the heat exchanger 34.

In the FIG. 7 contrived or folded-out illustration of the FIG. 4 embodiment 10*a*, index numbers which carry suffixes are used to signify components which are substantially similar to components which are signified by the same index numbers. The same is true of all figures comprised by this disclosure; similar or like index numbers indicate similar or like items of structure. In FIG. 7 then, the first, second, and third stage gears 50, 52, and 52*a* are shown coupled to their corresponding impellers 36, 28, and 38*a*. The compressed gas product of the first stage is heat exchanged in heat exchanger 34, dried in demister 86, and passed to the domed closure or closure head 70 for conduct through pipe 76 and elbow 78*a* for address to the second stage impeller 38. Again, the product of the second stage is cooled in heat exchanger 34*a*, dried in demister 86*a*, and passed to the domed closure or closure head 70*b*. Thence, it is conducted via delivery pipe 80 to the third stage 82 for address to the third stage impeller 38*a*, and discharged via diffuser 60*a* and conduit 32.

While I have described my invention in connection with specific embodiments thereof, it is to be clearly understood that this is done only by way of example, and not as a limitation to the scope of my invention as set forth in the objects thereof and in the appended claims.

I claim:

1. An improved gas compressor, comprising a gear housing; a driving gear and at least two driven gears enclosed within said housing; said driven gears being in engagement with said driving gear for rotation therewith on parallel, driven axes; said housing having parallel walls; a power input shaft, in penetration of one of said walls, drivingly coupled to said driving gear; at least two impellers for compressing gas, each impeller coupled to one of said driven gears externally of said housing; and means for admitting and discharging gas to and from said impellers; wherein the improvement comprises:

at least two, annular, spaced-apart flanges projecting externally from the other of said parallel walls;

said flanges each being concentric with, and circumscribing one of said impellers; and wherein said gas admitting and discharging means comprises a first, domed closure assembly having means coupling said first closure assembly to one of said annular flanges, and a second, domed closure assembly having means coupling said second closure assembly to another of said annular flanges;

each of said closure assemblies comprising a first conduit for conducting gas therethrough to such impeller, of said at least two impellers, which is associated therewith, and a generally cup-shaped, closure head;

said first conduit being in penetration of said closure head, having a terminal opening at one end thereof inside of said closure head, and a terminal opening at the other end thereof outside of said closure head, defining an annular chamber, inside of said closure head, concentric with said associated impeller's driven axis; further including a second conduit, coupled to and projecting from each of said closure heads, opening through said closure head and onto said annular chamber; and wherein said coupling means of each of said closure assemblies comprises an annular, terminal flange, concentric with said first conduit, which is replaceably secured, externally of said compressor, to one of said spaced-apart, externally-projecting flanges of said other wall, to accommodate removal and installation of each of said closure assemblies independently of others thereof and without any further dismantling or assembly of said compressor.

2. An improved gas compressor, according to claim 1, wherein:

said second conduit projects from said closure head transverse to said axes.

3. An improved gas compressor, according to claim 1, further including:

means replaceably coupled to said other wall at least one of said first and second domed closure assemblies for heat exchanging coolant with gas discharged from said associated impeller.

4. An improved gas compressor, according to claim 1, further including:

means coupled to said second conduit of one of said closure heads and to said first conduit of another of said closure heads, external of said compressor, for conducting gas therebetween.

5. An improved gas compressor, according to claim 3, wherein:

said heat exchanging means includes a pipe in penetration thereof which communicates with said first conduit.

6. An improved gas compressor, according to claim 3, wherein:

said heat exchanging means comprises a subassembly of annular cross-section which is concentric with said associated impeller and said first conduit.

7. An improved gas compressor, according to claim 3, wherein:

said heat exchanging means includes demister means for entraining moisture and removing the same from gas.

8. An improved gas compressor, according to claim 3, further including:

means coupled to said second conduit of said at least one domed closure assembly and to said first conduit of another of said domed closure assemblies, external of said compressor, for conducting gas therebetween.

9. For use with a gas compressor or the like, an improved heat exchanging assembly, comprising a housing; means defining an annular heat exchanger confined within said housing; said heat exchanger having a central, through-traversing pipe for admitting gas therethrough into said housing; and means for discharging gas from said housing through said heat exchanger; wherein the improvement comprises:

a generally cup-shaped closure head at one end of said housing;

said one end of said housing and said closure head having mating, interfacing flanges;

said interfacing flanges being separably fastened together;

said closure head having a conduit in penetration thereof;

said conduit opening at one end thereof externally of said closure head, and opening internally of said closure head in communication with said through-traversing pipe;

said housing being open-ended at the end thereof opposite said one end;

said opposite end of said housing having an external coupling flange formed thereon; and said one end of said conduit also having an external coupling flange formed thereon; wherein said conduit cooperates with said closure head to define an annular chamber within said closure head; and further including a gas discharge pipe opening at one end thereof through said closure head and onto said annular chamber therewithin, and opening at the other end thereof externally of said closure head; and said other end of said gas discharge pipe has an external coupling flange formed thereon.

10. An improved heat exchanging assembly, according to claim 9, further including:

demister means, confined within said annular chamber in said closure head, for entraining and removing moisture from gas.

* * * * *

UNITED STATES PATENT OFFICE

CERTIFICATE OF CORRECTION

Patent No. 4,087,197 Dated May 2, 1978

Inventor(s) Ronald L. Haugen

It is certified that error appears in the above-identified patent and that said Letters Patent are hereby corrected as shown below:

Column 5, line 18, after "wall" insert -- and --.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*